US007375725B2

(12) United States Patent
Sato et al.

(10) Patent No.: US 7,375,725 B2
(45) Date of Patent: May 20, 2008

(54) DISPLAY DEVICE

(75) Inventors: Hideo Sato, Hitachi (JP); Tomohiko Sato, Fujisawa (JP); Masahiro Maki, Mobara (JP); Takayuki Nakao, Mobara (JP)

(73) Assignee: Hitachi Displays, Ltd., Mobara-shi (JP)

( * ) Notice: Subject to any disclaimer, the term of this patent is extended or adjusted under 35 U.S.C. 154(b) by 712 days.

(21) Appl. No.: 10/998,002

(22) Filed: Nov. 29, 2004

(65) Prior Publication Data

US 2005/0116654 A1 Jun. 2, 2005

(30) Foreign Application Priority Data

Nov. 27, 2003 (JP) ..... 2003-396489

(51) Int. Cl.
*G09G 3/36* (2006.01)

(52) U.S. Cl. ..... 345/204; 345/95; 345/99; 345/212

(58) Field of Classification Search ..... 345/92, 345/95, 99, 204, 205, 206, 212
See application file for complete search history.

(56) References Cited

U.S. PATENT DOCUMENTS 6,384,806 B1 * 5/2002 Matsueda et al. ..... 345/89
2002/0063703 A1 * 5/2002 Furuhashi et al. ..... 345/212
2004/0135778 A1 * 7/2004 Sato et al. ..... 345/204

FOREIGN PATENT DOCUMENTS

JP 6-178238 6/1994
JP 11-272242 10/1999

* cited by examiner

*Primary Examiner*—Richard Mjerpe
*Assistant Examiner*—Vincent E. Kovalick
(74) *Attorney, Agent, or Firm*—Antonelli, Terry, Stout & Kraus, LLP.

(57) ABSTRACT

Gamma correction of a video signal voltage applied to respective pixels of a display device can be accomplished without modulating a ramp voltage. The display device includes a common voltage generating circuit which selectively outputs a high-potential-side common voltage or a low-potential-side common voltage to common electrodes in response to an alternating signal, a data storage circuit, a reference data generating circuit which, a ramp voltage generating circuit, a plurality of comparing circuits which compare data stored in the data storage circuit and the reference data generated by the reference data generating circuit, and a plurality of sampling circuits which sample the ramp voltage generated by the ramp voltage generating circuit in response to comparison results of the comparing circuits and output the sampled ramp voltage as a video signal voltage to respective video lines. The reference data generated by the reference data generating circuit is changed non-linearly with respect to time.

9 Claims, 10 Drawing Sheets

| M | in[i] | out[i] |
|---|---|---|
| 0 | 0 | 1 |
| 0 | 1 | 0 |
| 1 | 0 | 0 |
| 1 | 1 | 1 |

i=0～5

| Nc | | fi |
|---|---|---|
| M=1 | M=0 | |
| Nc≦N1 | Nc≦BN6 | f4 |
| N1<Nc≦N2 | BN6<Nc≦BN5 | f3 |
| N2<Nc≦N3 | BN5<Nc≦BN4 | f2 |
| N3<Nc≦N4 | BN4<Nc≦BN3 | f1 |
| N4<Nc≦N5 | BN3<Nc≦BN2 | f2 |
| N5<Nc≦N6 | BN2<Nc≦BN1 | f3 |
| N6<Nc | BN1<Nc | f4 |

FIG. 10
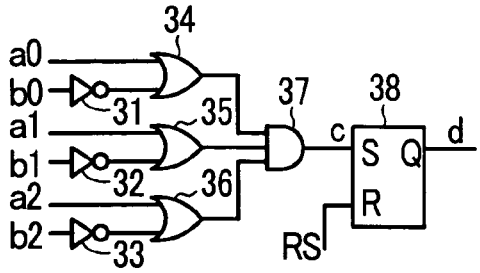
FIG. 11
| a2 | a1 | a0 | c | | | | | | | |
|---|---|---|---|---|---|---|---|---|---|---|
| | | | b=000 | b=001 | b=010 | b=011 | b=100 | b=101 | b=110 | b=111 |
| 0 | 0 | 0 | 1 | 0 | 0 | 0 | 0 | 0 | 0 | 0 |
| 0 | 0 | 1 | 1 | 1 | 0 | 0 | 0 | 0 | 0 | 0 |
| 0 | 1 | 0 | 1 | 0 | 1 | 0 | 0 | 0 | 0 | 0 |
| 0 | 1 | 1 | 1 | 1 | 1 | 1 | 0 | 0 | 0 | 0 |
| 1 | 0 | 0 | 1 | 0 | 0 | 0 | 1 | 0 | 0 | 0 |
| 1 | 0 | 1 | 1 | 1 | 0 | 0 | 1 | 1 | 0 | 0 |
| 1 | 1 | 0 | 1 | 0 | 1 | 0 | 1 | 0 | 1 | 0 |
| 1 | 1 | 1 | 1 | 1 | 1 | 1 | 1 | 1 | 1 | 1 |
FIG. 12
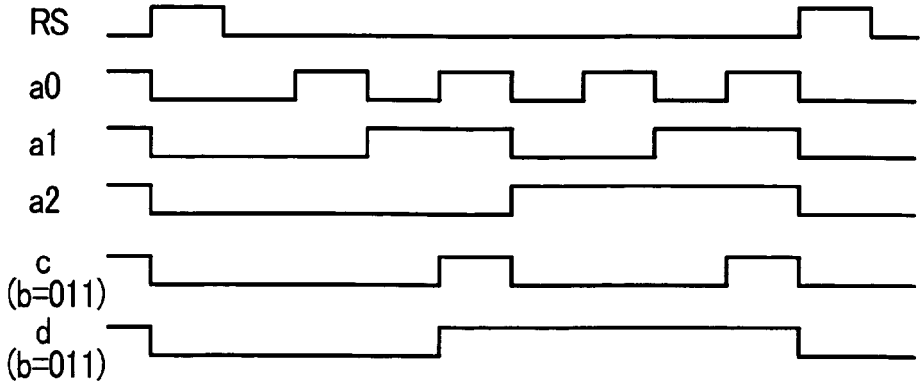

DISPLAY DEVICE

The present application claims priority from Japanese application JP2003-396489 filed on Nov. 27, 2003, the content of which is hereby incorporated by reference into this application.

BACKGROUND OF THE INVENTION

The present invention relates in general to a display device, and, more particularly, the invention relates to a technique which is effective when applied to the gamma correction of a video signal voltage that is applied to respective pixels in a display device.

A liquid crystal display module of the TFT (Thin Film Transistor) type has been popularly used as a display device in a notebook type personal computer and the like. As this type of liquid crystal display module, a liquid crystal display module which uses polysilicon in a semiconductor layer of a thin film transistor (TFT) (hereinafter also referred to as a "polysilicon-type liquid crystal display module") has been known.

In this polysilicon type liquid crystal display module, the following known method has been employed. That is, display data within one horizontal scanning line period is stored, reference data which is sequentially increased or decreased within one horizontal scanning line period is generated, and the stored display data and the reference data are compared. Then, when the stored display data and the reference data coincide with each other, a video signal voltage generated by a video signal voltage generating circuit is sampled and is applied to respective pixels (hereinafter referred to as "PWM method") (see Japanese Unexamined Patent Publication JP-A-6-178238 (patent literature 1) and JP-A-11-272242 (patent literature 2)).

As the above-mentioned video signal voltage generated by the video signal voltage generating circuit, a voltage in having a voltage waveform which is in the form of an inclined wave (a so-called "ramp voltage") is used.

SUMMARY OF THE INVENTION

As described in the above-referenced patent literature 1, it is necessary to perform gamma correction on the video signal voltage to be applied to respective pixels in view of the transmissivity curve of the liquid crystal. In the liquid crystal display devices described in the above-mentioned patent literatures 1, 2, this gamma correction is performed in the video signal voltage generating circuit.

FIG. 19 of the accompanying drawings is a view showing an example of a conventional gamma correction method. That is, FIG. 19 is a view which illustrates a gamma correction method which is disclosed in FIG. 7 of the above-mentioned patent literature 1 or in FIG. 14 of the above-mentioned patent literature 2. As shown in these drawings, the gamma correction method described in the patent literatures 1, 2 is a method which modulates an output of a ramp voltage generating circuit in conformity with required gamma characteristics.

To be more specific, these patent literatures 1, 2 disclose a method in which gamma characteristics are preliminarily stored in a memory (MM), values of the memory (MM) are sequentially read out, and these values are converted into analogue voltages by a digital/analogue converter (DAC). In FIG. 19, symbol AMP indicates an amplifier which amplifies the analogue voltages obtained by the conversion in the digital/analogue converter (DAC), and symbol RAMP indicates ramp voltages outputted from the amplifier (AMP).

However, in the above-mentioned method, a digital/analogue converter having a high resolution becomes necessary, and such a digital/analogue converter having a high resolution is constituted by a large-scale circuit and is required to operated with an extremely high accuracy. Accordingly, there has been a drawback in that the digital/analogue converter cannot be formed on the substrate on which the display panel is formed.

Further, the output of the ramp voltage generating circuit is delayed, which is attributed to the line capacitance of a video line (drain line) in the inside of the display panel, and the voltage error attributed to this delay depends on the inclination of the ramp voltage with respect to time. In performing gamma correction, this inclination differs for every region and the maximum inclination is increased. Accordingly, there has been a drawback in that the error is increased, and, at the same time, the error differs for every region.

Accordingly, it is an object of the present invention to provide a display device which can perform gamma correction on video signal voltages applied to respective pixels without modulating the ramp voltage.

The above-mentioned and other objects and novel features of the present invention will become apparent, based on the following description in this specification and the attached drawings.

A brief explanation of representative aspects of the invention disclosed in this specification is as follows.

The present invention is directed to a display device which includes a display part having a plurality of pixels, a plurality of video lines which supply a video signal voltage to the plurality of pixels, and a drive circuit which supplies the video signal voltage to the plurality of video lines, wherein the display part includes common electrodes. The drive circuit includes a common voltage generating circuit which selectively outputs a high-potential-side common voltage or a low-potential-side common voltage to the common electrodes in response to an alternating signal, a storage circuit which stores display data, a reference data generating circuit which generates reference data, a ramp voltage generating circuit which generates a ramp voltage, a plurality of comparing circuits which compare data stored in the storage circuit and the reference data generated by the reference data generating circuit, and a plurality of sampling circuits which sample a ramp voltage generated by the ramp voltage generating circuit and which output the sampled ramp voltage as a video signal voltage to respective video lines in response to comparison results of the comparing circuits, wherein the reference data generated by the reference data generating circuit is changed non-linearly with respect to time.

An advantageous effect obtained by the present invention disclosed in this specification is as follows. That is, according to the present invention, it is possible to realize a display device having a high image quality and which also exhibits a low power consumption.

BRIEF DESCRIPTION OF THE DRAWINGS

FIG. 10 is a circuit diagram showing the circuit constitution of one example of a comparator shown in FIG. 5;

FIG. 11 is a truth table of a comparator circuit shown in FIG. 10;

FIG. 12 is a timing chart when b=011 in the comparator circuit shown in FIG. 10;

DESCRIPTION OF THE PREFERRED EMBODIMENTS

Preferred embodiments of the present invention will be explained in detail hereinafter in conjunction with the attached drawings. In all of the drawings, parts having identical functions are indicated by the same symbols, and their repeated explanation thereof is omitted.

Embodiment 1

Figure 1:
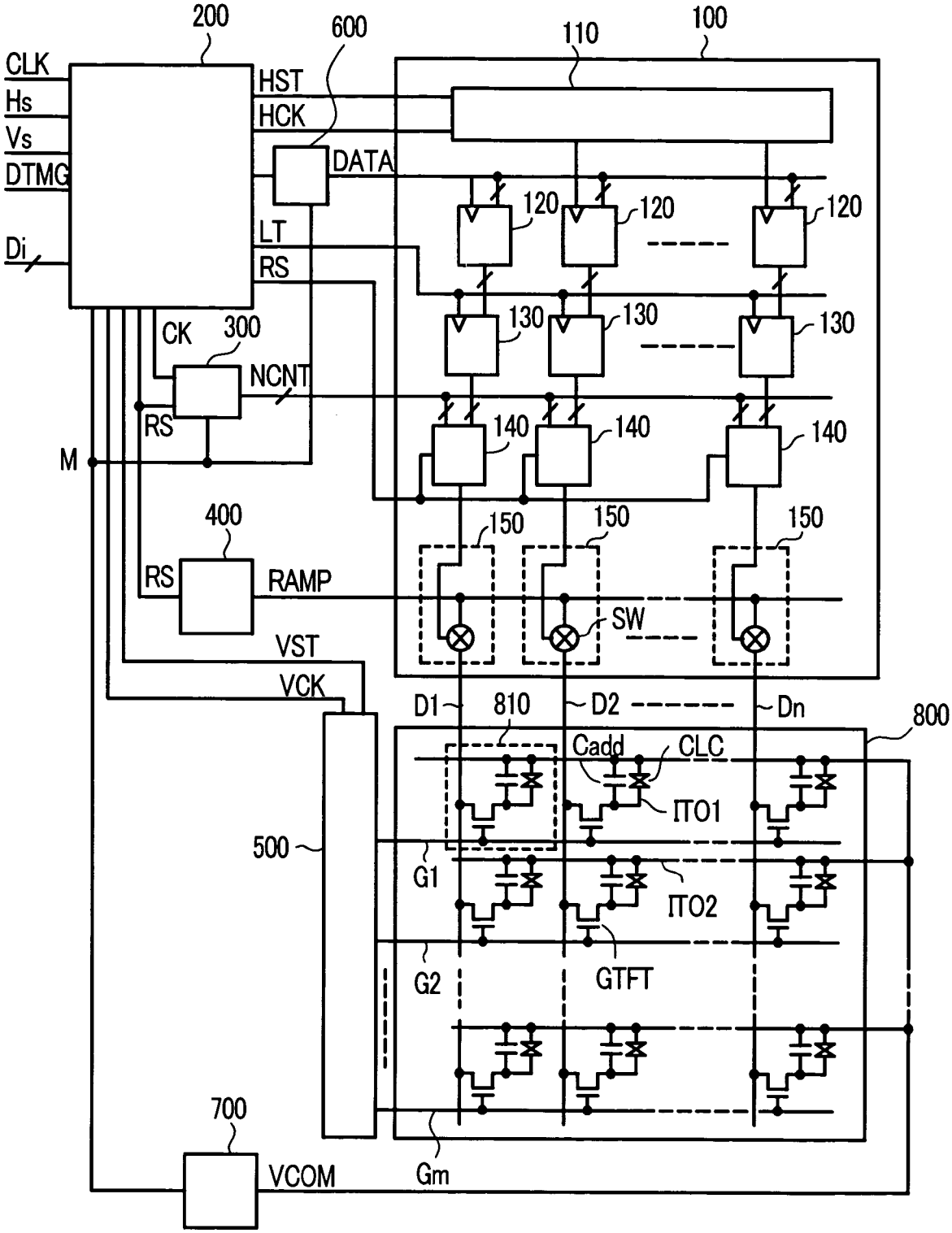
FIG. 1 is a block diagram showing the schematic constitution of a liquid crystal display module representing an embodiment 1 of the present invention.

FIG. 1 is block diagram showing the schematic constitution of a liquid crystal display module representing an embodiment 1 of the present invention. The liquid crystal display module of this embodiment is a polysilicon type liquid crystal display module which uses polysilicon in semiconductor layers of thin film transistors (TFT).

The liquid crystal display module of this embodiment is constituted of a drain driver (video signal drive circuit) 100, a timing control circuit 200, a reference data generating circuit 300, a ramp voltage generating circuit 400, a gate driver (scanning signal drive circuit) 500, a complement circuit 600, a common voltage generating circuit 700, and a display part 800.

The display part 800 includes a plurality (m×n) of pixels 810 which are arranged in a matrix array, video lines (also referred to as "drain lines") D which supply a video signal voltage to the respective pixels, and scanning lines (also referred to as gate lines) G which supply a scanning signal voltage to the respective pixels.

Each pixel includes a pixel transistor (GTFT) which is constituted of a thin film transistor. The pixel transistor (GTFT) is connected between the video line (D) and a pixel electrode (ITO1), and the gate of the pixel transistor (GTFT) is connected to the scanning line (G).

Since liquid crystal is sealed between the pixel electrodes (ITO1) and the common electrodes (ITO2), pixel capacitances (CLC) are equivalently connected between the pixel electrodes (ITO1) and the common electrodes (ITO2). Further, between the pixel electrodes (ITO1) and the common electrodes (ITO2), holding capacitances (Cadd) are equivalently connected.

The drain driver 100 is constituted of a shift register 110, latch circuits 120, latch circuits 130, comparators 140, and sample holding circuits 150.

Into the timing control circuit 200, a clock (CLK), a horizontal synchronizing signal (Hs), a vertical synchronizing signal (Vs), a display timing signal (DTMG) and display data (Di) are inputted. On the other hand, the timing control circuit 200 generates signals which control the drain driver 100, the reference data generating circuit 300, the ramp voltage generating circuit 400, the gate driver 500, the complement circuit 600 and the common voltage generating circuit 700.

Hereinafter, the driving method employed in the operation of the liquid crystal display module of this embodiment will be explained.

In general, when the same voltage (DC current) is applied to the liquid crystal layer for a long time, the inclination of the liquid crystal layer is fixed, and, eventually, an image retention phenomenon is induced, thus shortening the lifetime of the liquid crystal layer.

To prevent such a phenomenon, in the liquid crystal display module, a voltage applied to the liquid crystal layer is alternated for every fixed period, that is, the voltage applied to the pixel electrodes (ITO1) is changed to the positive voltage side/negative voltage side for every fixed time with reference to the voltage supplied to the common electrodes (ITO2).

As a drive method for applying the AC voltage to the liquid crystal layer, a common symmetry method and a common inversion method have been known. The common symmetry method is a drive method in which a common voltage (VCOM) supplied to the common electrodes (ITO2) is not changed and a voltage supplied to the pixel electrodes (ITO1) is changed over to the positive voltage side (high potential side) and the negative voltage side (low potential side) for every fixed period with respect to the common voltage (VCOM).

In contrast, the common inversion method is a drive method in which a common voltage (VCOM) supplied to the common electrodes (ITO2) is changed over between two kinds of voltages, that is, a high-potential-side common voltage (VCOMH) and a low-potential-side common voltage (VCOML) for every fixed period. Then, when the low-potential-side common voltage (VCOML) is applied to the common electrodes (ITO2), a gray scale voltage having a potential higher than that of the low-potential-side common voltage (VCOML) is applied to the pixel electrodes (ITO1). On the other hand, when the high-potential-side common voltage (VCOMH) is applied to the common electrodes (ITO2), a gray scale voltage having a potential lower than that of the high-potential-side common voltage (VCOMH) is applied to the pixel electrodes (ITO1).

The liquid crystal display module of this embodiment adopts, as the AC drive method, the common inversion method in which the common voltage (VCOM) which is applied to the common electrodes (ITO2) is alternately inverted to the high potential side and the low potential side for every one line. By adopting this common inversion method, as the thin film transistors in the inside of the drain driver 100, it is possible to use a low-dielectric-strength transistor of 5V series, for example.

Figure 2:
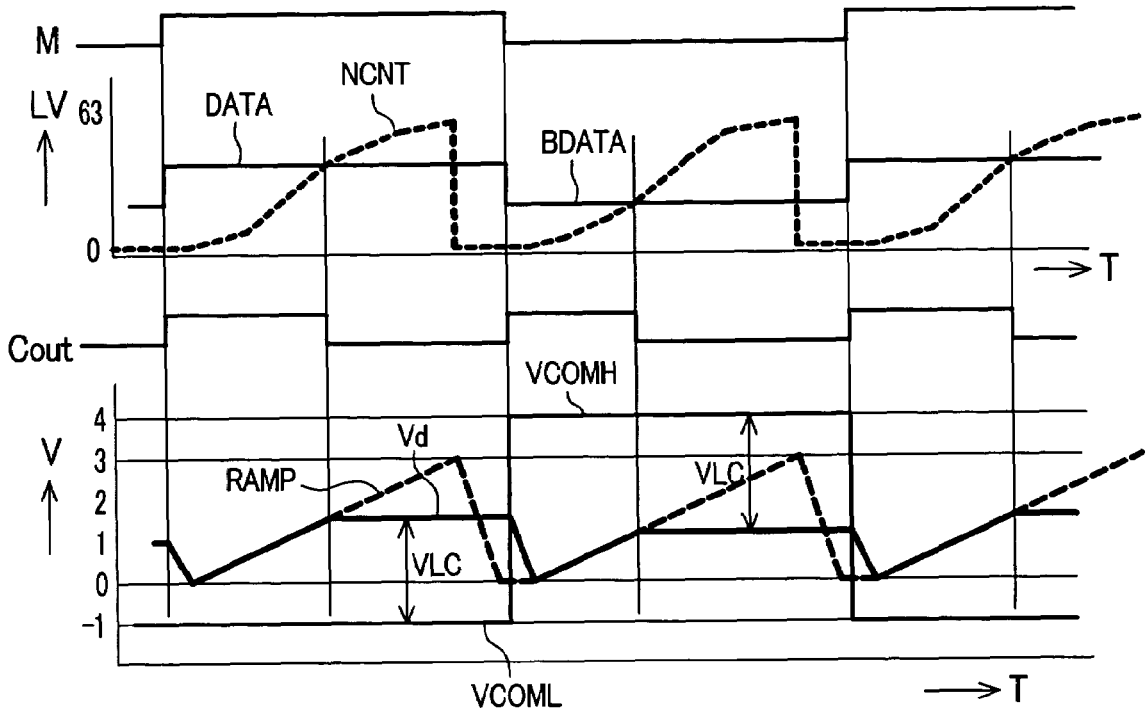
FIG. 2 is a timing chart showing the manner of operation of the liquid crystal display module of the embodiment 1 of the present invention.

FIG. 2 is a timing chart showing the manner of operation of the liquid crystal display module of this embodiment. In FIG. 2, symbol LV indicates display data of a plurality of gray scales (64 gray scales), symbol V indicates a common voltage applied to the common electrodes (ITO2) and one example of a gray scale voltage applied to the video lines (D), and symbol T indicates time.

The alternating signal (M) shown in FIG. 2 is a logic signal which controls the polarity of the video signal voltage applied to the pixel electrodes of the display part 800, and the logic thereof is inverted for every line and for every frame.

In FIG. 2, when the alternating signal (M) assumes the High level (hereinafter referred to as the "H level"), the low-potential-side common voltage (VCOML, in FIG. 2, the voltage of −1V) is applied to the common electrodes (ITO2); while, when the alternating signal (M) assumes the Low level (hereinafter referred to as the "L level"), the high-potential-side common voltage (VCOMH, in FIG. 2, the voltage of 4V) is applied to the common electrodes (ITO2).

Here, in this embodiment, although a negative potential is used as the low-potential-side common voltage (VCOML), the embodiment is not limited to such a value and may employ a positive potential. That is, it is sufficient provided that the low-potential-side common voltage (VCOML) assumes a potential relatively lower than the potential of the high-potential-side common voltage (VCOMH).

Further, in applying the low-potential-side common voltage to the common electrodes (ITO2), it is necessary to apply a first gray scale voltage (Vd) having a potential higher than the potential of the low-potential-side common voltage to the video lines (D); while, in applying the high-potential-side common voltage to the common electrodes (ITO2), it is necessary to apply a second gray scale voltage having a potential lower than the potential of the high-potential-side common voltage to the video lines (D).

To this end, when the alternating signal (M) assumes the L level, it is necessary for the ramp voltage which is outputted from the ramp voltage generating circuit 400 to have an inclined wave which is simply decreased (ramp voltage having a negative inclination).

However, in this embodiment, the ramp voltage (RAMP) which is outputted from the ramp voltage generating circuit 400 is a ramp voltage having a positive inclination during a period in which sampling is performed. Accordingly, the ramp voltage (RAMP) becomes an inclined wave in which, when the alternating signal (M) assumes the H level, the potential difference between the ramp voltage (RAMP) and the low-potential-side common voltage (VCOML) is increased along with the lapse of time (T); and, when the alternating signal (M) assumes the L level, the potential difference between the ramp voltage (RAMP) and the high-potential-side common voltage (VCOMH) is decreased along with the lapse of time (T).

Accordingly, in this embodiment, by providing the complement circuit 600, when the alternating signal (M) assumes the L level, the complement of the display data (DATA) is taken in the complement circuit 600. That is, in this embodiment, the display data (DATA) which is transmitted from the timing control circuit 200 is inputted to the complement circuit 600.

Figure 3:
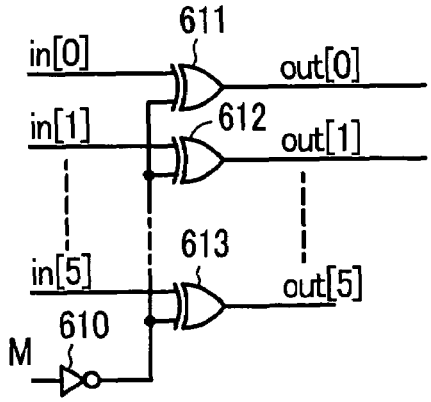
FIG. 3 is a circuit diagram showing the circuit constitution of one example of a complement circuit shown in FIG. 1.
Figures 4, 5:
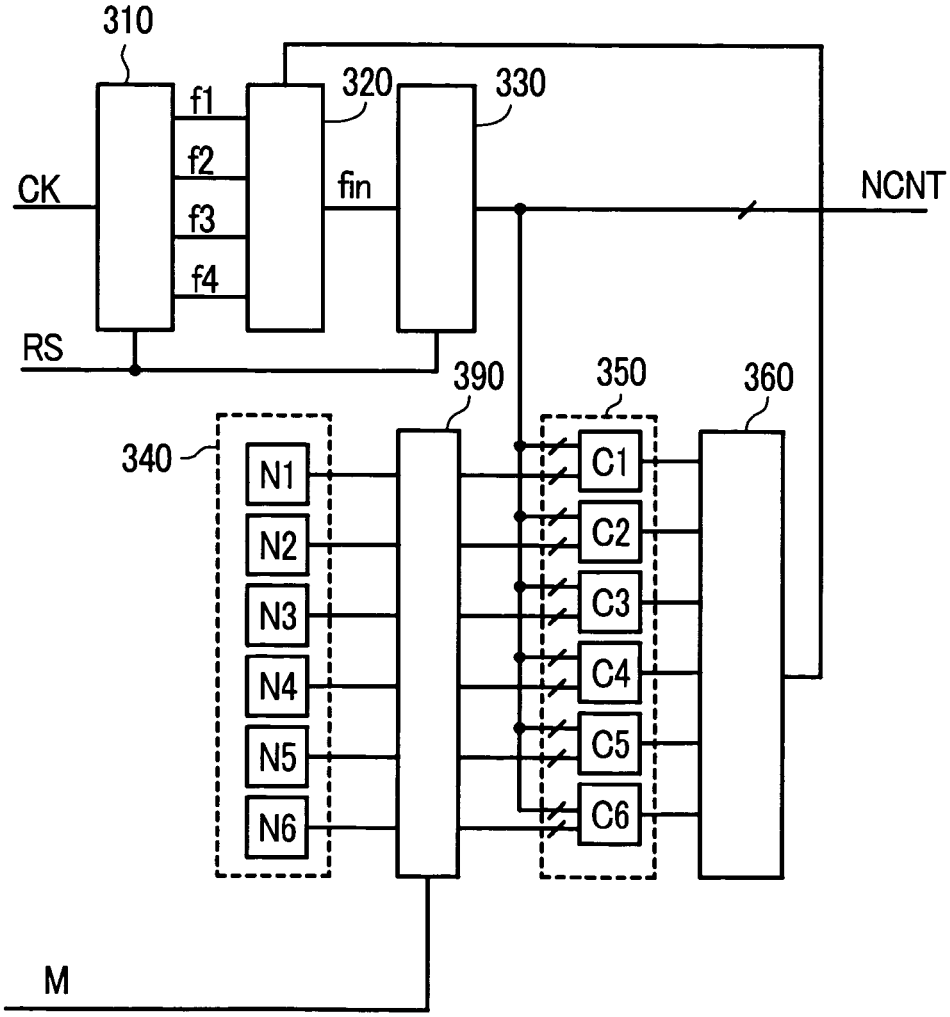
FIG. 4 is a truth table of the complement circuit shown in FIG. 3.
FIG. 5 is a block diagram showing the schematic constitution of a reference data generating circuit shown in FIG. 1.

FIG. 3 is a circuit diagram showing the circuit constitution of one example of the complement circuit 600 shown in FIG. 1, and a truth table of the complement circuit 600 shown in FIG. 3 is shown in FIG. 4. The complement circuit shown in FIG. 3 is constituted of EXCLUSIVE-OR circuits 611, 612, 613 in which the respective bit numbers (in[0] to in[5]) of the display data inputted from the outside and the alternating signal (M) inverted by an inverter 610 are inputted.

As shown in FIG. 4, in the complement circuit shown in FIG. 3, when the alternating signal (M) assumes the H level, the display data which is inputted from the outside is directly outputted as it is, while when the alternating signal (M) assumes the L level, the complement data which is obtained by inverting the display data inputted from the outside is outputted. That is, the complement circuit 600 outputs the inputted display data (DATA) as it is when the alternating signal (M) assumes the H level and outputs the complement data (BDATA) of the inputted display data when the alternating signal (M) assumes the L level.

In FIG. 1, the shift register 110 is operated in response to the start signal (HST) and the clock signal (HCR), which are transmitted from the timing control circuit 200, and it outputs a multiple-phase pulse to control the latch circuits 120.

The latch circuits 120 sequentially hold the data (DATA, BDATA) outputted from the complement circuit 600 amounting to one horizontal scanning line in response to the multiple-phase pulse. When a timing signal (LT) indicative of the completion of transfer of the display data amounting to one horizontal scanning line, which is transmitted from the timing control circuit 200, is inputted to the latch circuits 130, the latch circuit 130 holds the display data of the latch circuits 120 altogether at the same timing. The comparators 140 compare the volumes of the data held in the latch circuits 130 and the reference data (NCNT) which is transmitted from the reference data generating circuit 300.

To be more specific, after the initialization in response to an initialization signal (RS), which is transmitted from the timing control circuit 200, when the reference data (NCNT) is smaller than or equal to the data held in the latch circuits 130, the comparators 140 output the H level (see Cout in FIG. 2).

The reference data generating circuit 300 is an up counter which receives the clock (CK) and the initialization signal (RS) transmitted from the timing control circuit 200 as inputs thereof.

The sample holding circuits 150 receive the outputs of the comparators 140 as inputs, as well as an output (RAMP) of the ramp voltage generating circuit 400, and they output the video signal voltage to the video lines (D) of the display part 800.

Switching elements (SW) of the sample holding circuits 150 are turned off when the output signals of the comparators 140 assume the L level. Accordingly, the sample holding circuits 150 sample the ramp voltage (RAMP) immediately before the switching elements (SW) are turned off and the sampled voltage is outputted to the video lines (D) as the video signal voltage (Vd). Here, the voltage applied to the liquid crystal assumes the level VLC shown in FIG. 2.

The gate driver 500 is operated in response to the start signal (VST) and the clock (VCK) transmitted from the timing control circuit 200, and it sequentially outputs the scanning signal which turns on the pixel transistors (GTFT) to the scanning lines (G) of the display part 800 during one horizontal scanning line period.

Due to the above-mentioned operations, an image is displayed on the display part 800.

In this embodiment, as the thin film transistor which constitutes the sample holding circuit 150, it is possible to use a thin film transistor with a low dielectric strength.

Further, when a thin film transistor which can be operated at a high speed with high mobility is used, it is possible to supply a larger amount of current even at a low voltage, and, hence, the dielectric strength is liable to become low. However, according to the present invention, a high-performance thin film transistor can be used, and, hence, the electric characteristics of the drain driver 100 can be enhanced, whereby a liquid crystal display device of high quality and with low power consumption can be realized.

One example of such a high-performance thin film transistor is a thin film transistor which is formed using a pseudo single crystallization technique. As an example of the pseudo single crystallization technique, there is a known technique in which a semiconductor layer, which is melted by scanning the semiconductor layer with continuous irradiation of oscillating laser beams onto the semiconductor layer, is grown in the lateral direction, thus recrystallizing the semiconductor layer, whereby semiconductor crystal which is grown in a strip shape is obtained.

Due to such a technique, the crystal grain boundary in a channel region of the thin film transistor is reduced, and, hence, thin film transistor of high mobility is obtainable. This method constitutes merely an example, and it should be understood that the thin film transistor may be formed using other methods.

Further, since the alternation is performed by the sample holding circuits 150, the ramp voltage (RAMP) outputted from the ramp voltage generating circuit 400 may have the same inclination regardless the alternating signal (M) and, at the same time, the dynamic range can be made small. Hence, the voltage amplitude is reduced, whereby the power consumption can be reduced.

Still further, the output impedance of the ramp voltage generating circuit 400 can be reduced, and, hence, the delay time can be shortened, whereby it is possible to obtain the display image of high quality.

In this embodiment, the gamma correction is performed by the reference data generating circuit 300. FIG. 5 is a block diagram showing the constitution of the reference data generating circuit 300 shown in FIG. 1.

The reference data generating circuit 300 includes a frequency dividing circuit 310, a selector 320, a counter 330, registers 340, comparators 350, a control circuit 360 and a complement control circuit 390.

The frequency dividing circuit 310 divides the frequency of the input clock (CK) and outputs four divided frequency signals (f1, f2, f3, f14). Here, in FIG. 5, symbol RS indicates an initialization signal.

Assuming that f0 is the reference frequency, the frequencies of the respective outputs of the frequency dividing circuit 310 are, respectively, f1/f0=1, f2/f0=½, f3/f0=¼, f4/f0=⅛.

In response to an output signal from the control circuit 360, the selector 320 selects one signal (input signal (fin)) out of four divided frequency signals (f1, f2, f3, f4) outputted from the frequency dividing circuit 310 and outputs a selected input signal (fin) to the counter 330. The counter 330 is an up counter which counts the input signal (fin).

In the registers 340, gamma correction data (N1 to N6) are preliminarily stored. In this embodiment, six data are provided. The gamma correction data (N1 to N6), which are recorded in the registers 340, are inputted to the complement control circuit 390.

The complement control circuit 390 has circuit constitution substantially equal to the circuit constitution shown in FIG. 3, wherein the complement control circuit 390 directly outputs the gamma correction data (N1 to N6) as it is when the alternating signal (M) assumes the H level and outputs the complement data (BN1 to BN6) of the gamma correction data (N1 to N6) when the alternating signal (M) assumes the L level. The comparators 350 compare an output value of the counter 330 with values of the data outputted from the complement control circuit 390 (the gamma correction data (N1 to N6) or the complement data (BN1 to BN6) of the gamma correction data (N1 to N6). The control circuit 360 controls the selector 320 by receiving outputs of the comparators 350 as inputs thereto.

Figures 6, 7:
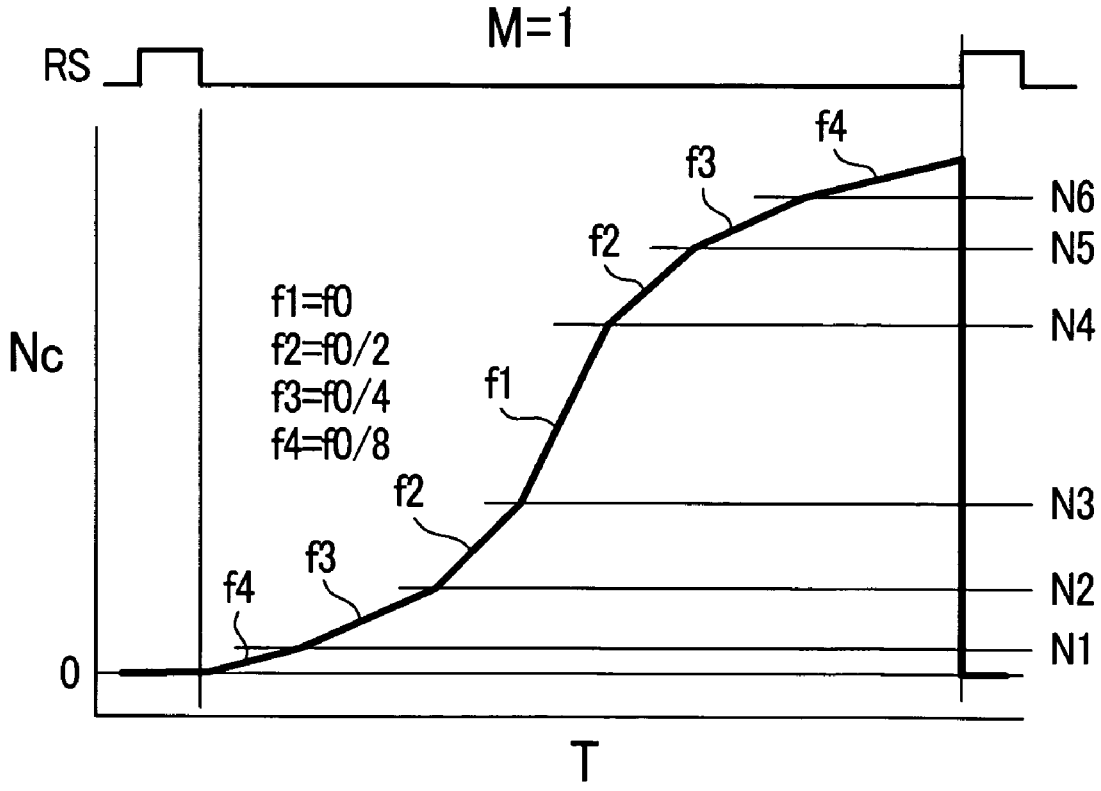
FIG. 6 is a table showing the relationship between a count value (Nc) of a counter shown in FIG. 5 and the frequency of an input signal (fin) inputted to the counter.
FIG. 7 is a graph showing the time response of the counter value of the reference data generating circuit when an alternating signal (M) is at a High level.

FIG. 6 shows the relationship between the count value (Nc) of the counter 330 shown in FIG. 5 and the frequency of the input signal (fin) inputted to the counter 330.

The control circuit 360 controls the frequency of the input signal (fin) inputted to the counter 330 based on the data value from the complement control circuit 390 and the counter value (Nc) from the counter 330, as shown in FIG. 6.

Figure 8:
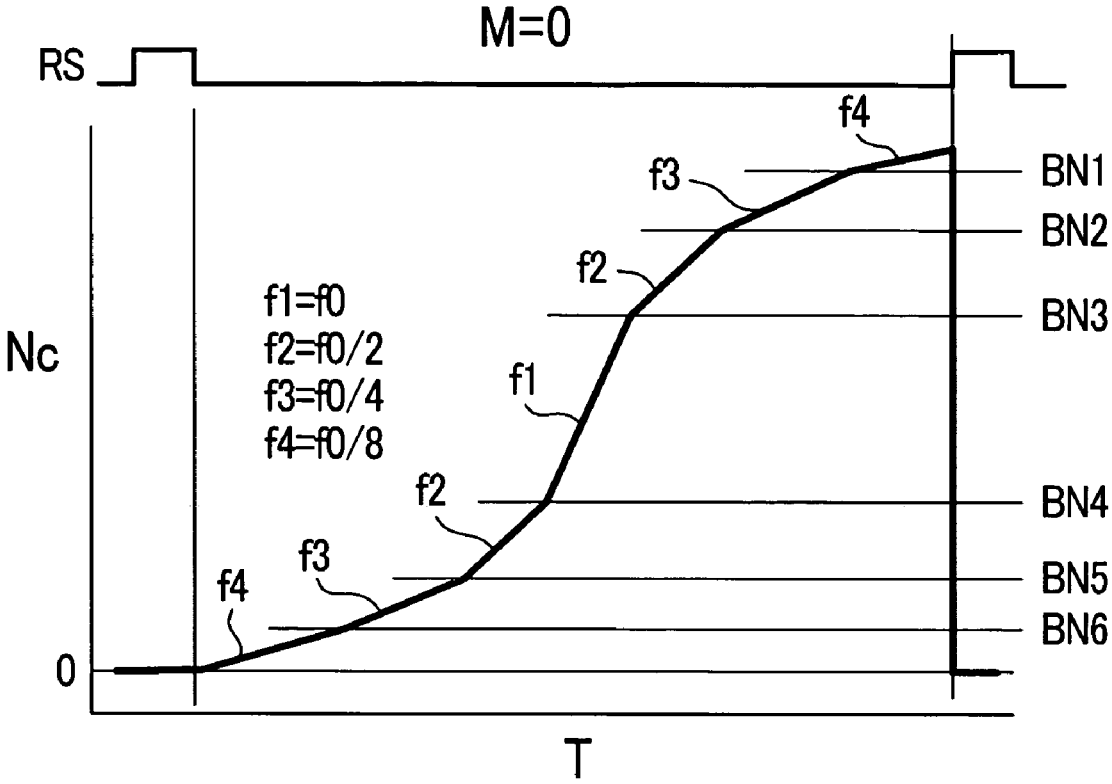
FIG. 8 is a graph showing the time response of the counter value of the reference data generating circuit when the alternating signal (M) is at a Low level.

FIG. 7 is a graph showing a time response of the counter value of the reference data generating circuit 300 when the alternating signal (M) assumes the H level, and FIG. 8 is a graph showing a time response of the counter value of the reference data generating circuit 300 when the alternating signal (M) assumes the L level. Here, in FIG. 7 and FIG. 8, symbol T indicates time and symbol Nc indicates the count value.

The counter 330 is reset in response to the initialization signal RS, and, thereafter, the frequency of the input signal (fin) is changed, as shown in FIG. 6, in the sequence f4→f3→f2→f1→f2→f3→f4.

In this case, with respect to the count value (Nc) of the reference data generating circuit 300, the inclination is gentle when the frequency of the input signal (fin) is low, and the inclination is steep when the frequency of the input signal (fin) is high. As a result, the time response of the count value of the reference data generating circuit 300 exhibits characteristics which are changed non-linearly with respect to time, as shown in FIG. 7 and FIG. 8. Accordingly, even when the inclination of the ramp voltage (RAMP) is substantially fixed, gamma correction can be performed.

As can be understood from FIG. 2, the ramp voltage (RAMP) outputted from the ramp voltage generating circuit 400 is in the form of an inclined wave in which, when the alternating signal (M) assumes the H level, the potential difference between the ramp voltage (RAMP) and the low-potential-side common voltage (VCOML) is increased along with the lapse of time; while, when the alternating signal (M) assumes the L level, the potential difference between the ramp voltage (RAMP) and the high-potential-side common voltage (VCOMH) is decreased along with the lapse of time.

Accordingly, it is also necessary to change the gamma correction between the operation in which the alternating signal (M) assumes the H level and the operation in which the alternating signal (M) assumes the L level; and, hence, in this embodiment, the complement control circuit 390 is provided to change the gamma correction amount between the operation in which the alternating signal (M) assumes the H level and the operation in which the alternating signal (M) assumes the L level.

Figure 9:
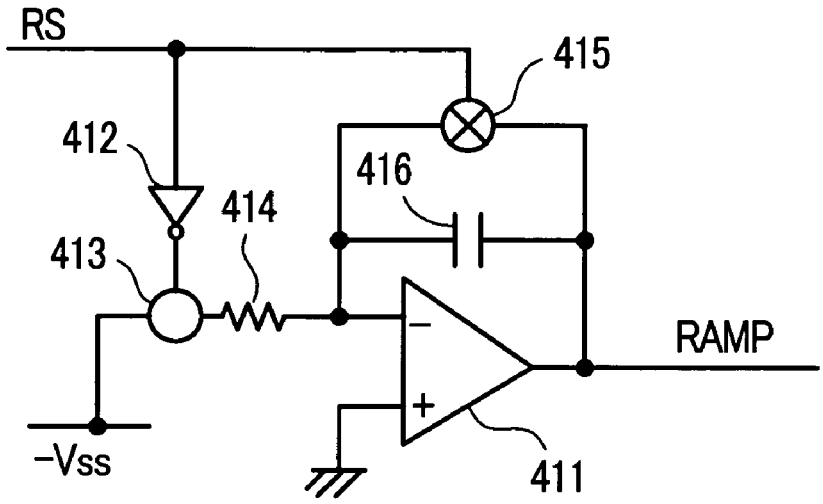
FIG. 9 is a circuit diagram showing the circuit constitution of one example of a ramp voltage generating circuit shown in FIG. 1.

FIG. 9 is a circuit diagram showing the circuit constitution of one example of the ramp voltage generating circuit 400 shown in FIG. 1. The ramp voltage generating circuit shown in FIG. 9 is constituted of an arithmetic amplifier 411, an inverter 412, switching elements (413, 415), a resistor 414 is and a capacitor 416.

In the ramp voltage generating circuit shown in FIG. 9, when the initialization signal (RS) assumes the H level, the switching element 413 is turned off and the switching element 415 is turned on. In this state, the ramp voltage generating circuit constitutes a voltage follower circuit, and, hence, the respective outputs assume the ground potential (GND).

Next, when the initialization signal (RS) assumes the L level, the switching element 413 is turned on and the switching element 415 is turned off. Accordingly, the capacitor 416 is charged, and, hence, the ramp voltage (RAMP) takes the form of an inclined wave which is elevated along with the lapse of time, as shown in FIG. 2.

In view of the time response of the count value (Nc) of the reference data generating circuit 300 shown in FIG. 7 and FIG. 8 and the time response of the ramp voltage generating circuit 400 shown in FIG. 2, the relationship between the count value (Nc) of the reference data generating circuit 300 and the output voltage (V) of the ramp voltage generating circuit 400 exhibits an inverse function of the time response of the count value (Nc) of the reference data generating circuit 300.

That is, the relationship between the voltage and the transmissivity of the driven liquid crystal (the gamma characteristics) can be corrected by setting the time response of the count value of the reference data generating circuit 300 to relationship similar to the gamma characteristics.

In this manner, according to this embodiment, by changing over the frequency of the input signal of the counter 330, which constitutes the reference data generating circuit 300, based on the count value (Nc) of the reference data generating circuit 300, it is possible to correct the gamma characteristics of the driven liquid crystal.

According to this method, the ramp voltage (RAMP) outputted from the ramp voltage generating circuit 400 can always have substantially a fixed inclination, and, hence, even when a delay occurs in the video line (D), the absolute value of the error is substantially fixed, whereby the influence of the delay to the display quality can be reduced.

Here, in this embodiment, in a case in which the usual display data (DATA) is transmitted from the timing control circuit 200 when the alternating signal (M) assumes the H level and the complement data (BDATA) of the display data is transmitted from the timing control circuit 200 when the alternating signal (M) assumes the H level, the above-mentioned complement circuit 600 is unnecessary.

FIG. 10 is a circuit diagram showing the circuit constitution of one example of the comparators 350 shown in FIG. 5. The circuit shown in FIG. 10 is of a comparator of 3 bit input type, and it is constituted of inverters (31, 32, 33), OR circuits (34, 35, 36), an AND circuit 37 and an SR flip-flop 38. In FIG. 10, symbols a0, a1, a2 indicate signals from the counter 330, and symbols b0, b1, b2 indicate signals from the complement control circuit 390.

In FIG. 11, a truth table of the comparator circuit shown in FIG. 10 is shown. FIG. 11 sets forth an output c of the AND circuit 37 for various combinations of the input signals. When the counter value of the counter 330 is increased from 0, the output c is changed from 0 to 1 at a point of time at which the value of b becomes equal to the counter value of the counter 330. By inputting this output c into the SR flip-flop 38, the output d of the SR flip-flop 38 assumes the H level, provided that the relationship a>b is established.

FIG. 12 is a timing chart when the signal b assumes b=011 in the comparator circuit shown in FIG. 10. The output c assumes the H level when the signal a assumes a=011 and a=111, and, hence, the output d of the SR flip-flop 38 assumes the H level, provided that the relationship a>b is established.

Figure 13:
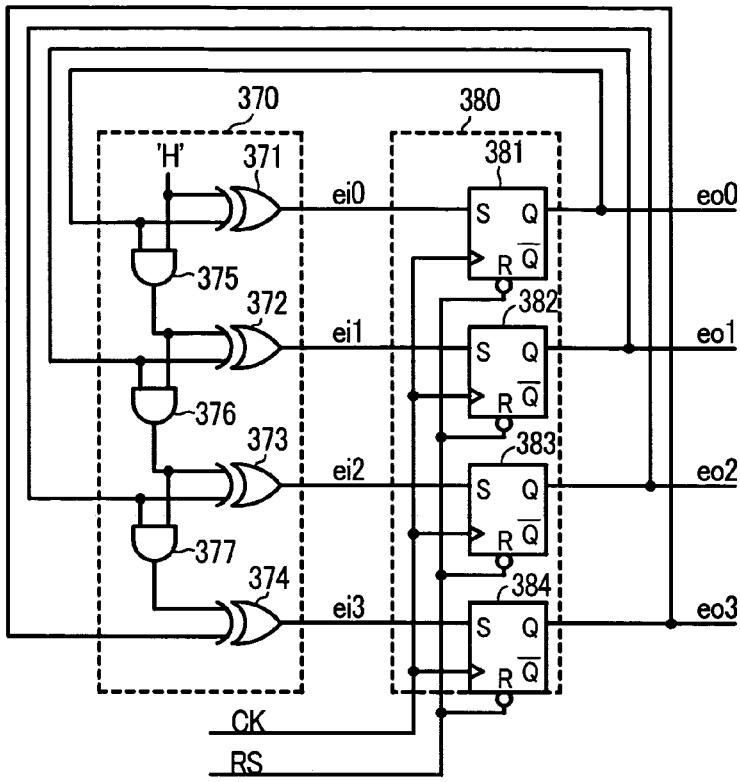
FIG. 13 is a circuit diagram showing one example of the circuit constitution of the counter shown in FIG. 5.

FIG. 13 is a circuit diagram showing one example of the circuit constitution of the counter 330 shown in FIG. 5.

The circuit shown in FIG. 13 is that of a 4 bit counter and is constituted of a latch circuit 380 and an incrementor 370.

The latch circuit 380 is constituted of D-type flip-flops (381 to 384). It is operated in response to the clock (CL), the initialization signal (RS) and inputs (ei0 to ei3), latches the input (ei0 to ei3) at the timing of clock (CK), and outputs the outputs (eo0 to eo3).

The incrementor 370 is constituted of AND circuits (375 to 377) and EOR circuits (EXCLUSIVE-OR circuits) (371 to 374), wherein "1" is added to an output of the latch circuit 380 and the output is inputted to the latch 380.

Due to such a constitution, it is possible to realize a synchronous-type counter 330 which adds "1" to the output of the latch circuit 380 at the timing of the clock (CK).

The counter 330 shown in FIG. 13 is also applicable to the frequency dividing circuit 310.

Figure 14:
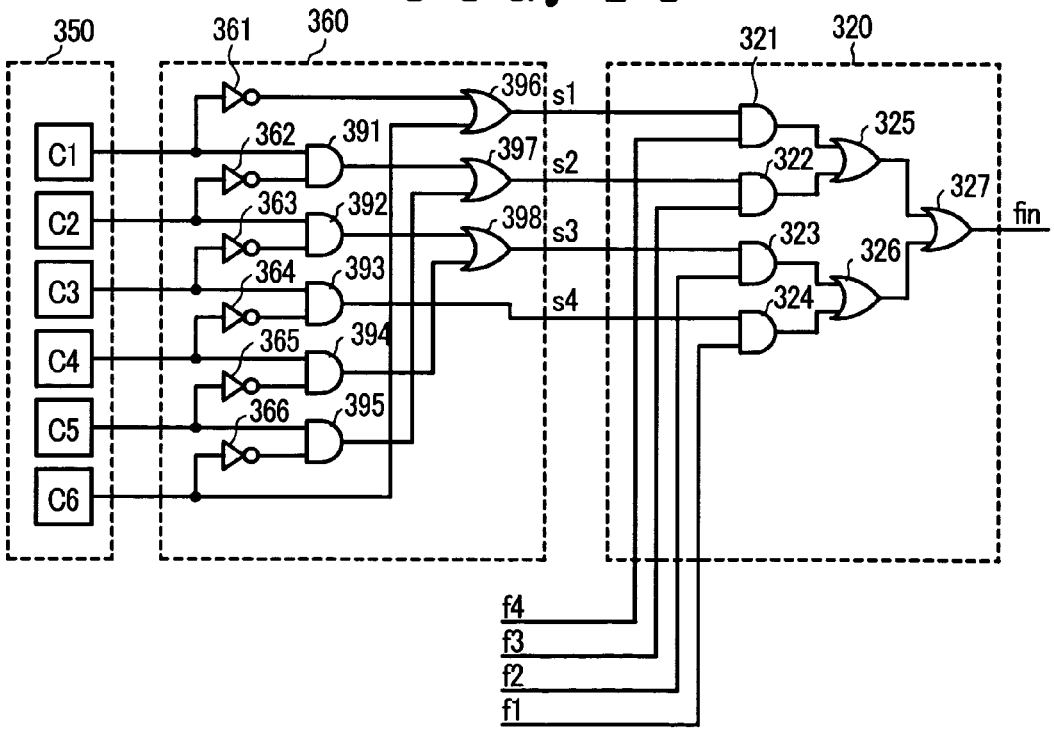
FIG. 14 is a circuit diagram showing one example of the circuit constitution of a control circuit and a selector shown in FIG. 5.

FIG. 14 is a circuit diagram showing one example of the circuit constitution of the control circuit 360 and the selector 320 shown in FIG. 5.

The control circuit 360 shown in FIG. 14 is constituted of inverters (361 to 366), AND circuits (391 to 395) and OR circuits (396 to 398), wherein the control circuit 360 receives the output of the comparator 350 as an input and outputs selector signals (s1 to s4).

The selector 320 is constituted of AND circuits (321 to 324) and OR circuits (325 to 327), and it selects one of the output signals (f1 to f4) of the frequency dividing circuit in response to the applied selector signals (s1 to s4) and outputs the input signal (fin).

As mentioned previously, the output of the comparator 350 assumes the H level in the order of C1→C2→C3→C4→C5→C6. To consider a case in which the outputs (C1 to C6) of the comparator 350 assume the L level, the selector signal (s1) assumes the H level and the frequency-divided signal having a frequency of f4 is selected as the input signal (fin) by the AND circuit 321.

Next, when the output (C1) of the comparator 350 assumes the H level, the selector signal (s2) assumes the H level by way of the AND circuit 391, and the frequency divided signal having the frequency of f3 is selected as the input signal (fin) by the AND circuit 322.

Thereafter, in the above-mentioned manner, the frequency divided signal selected by the selector 320 is changed in the order of f4→f3→f2→f1→f2→f3→f4.

Embodiment 2

Figure 15:
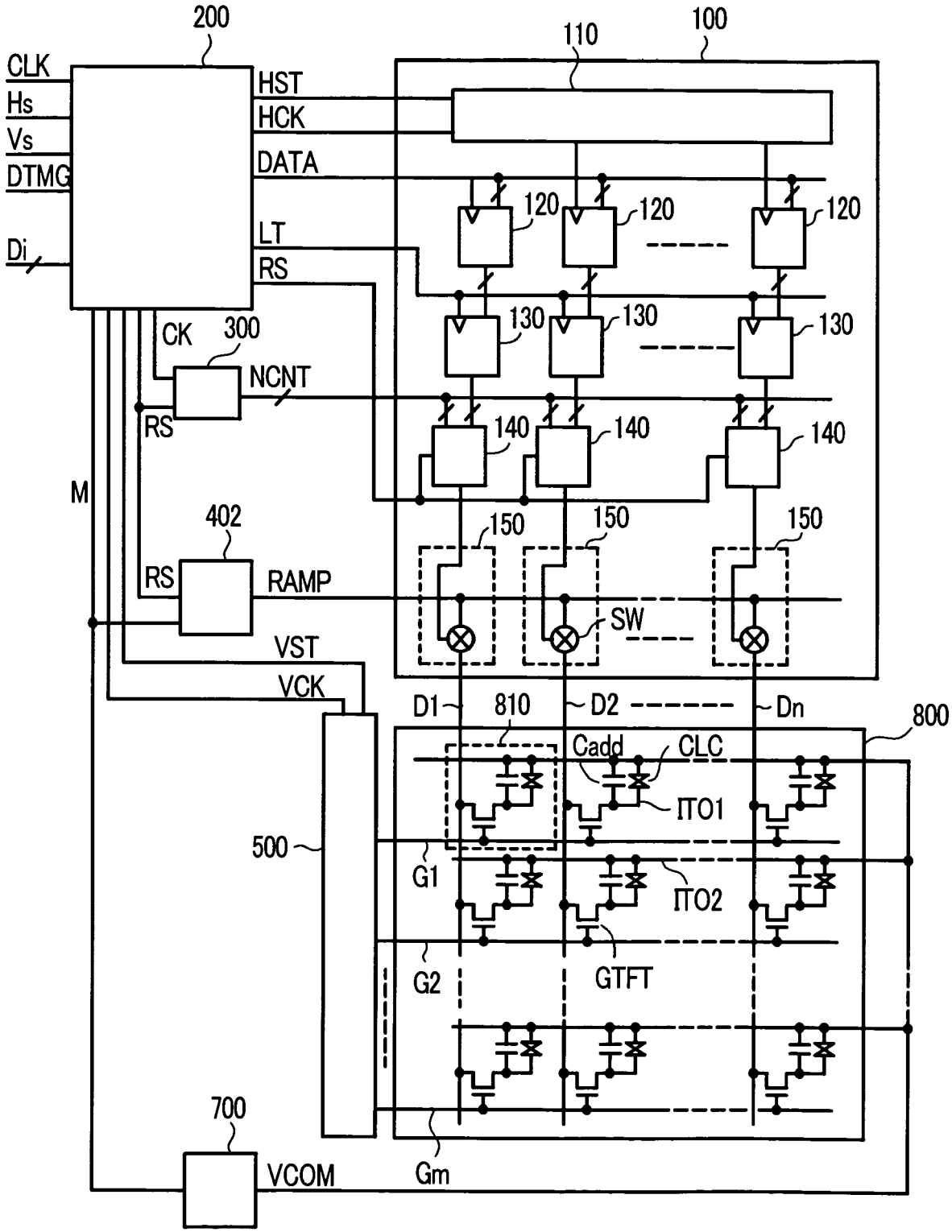
FIG. 15 is a block diagram showing the schematic constitution of a liquid crystal display module representing an embodiment 2 of the present invention.

FIG. 15 is a block diagram showing the constitution of a liquid crystal display module representing an embodiment 2 of the present invention.

The liquid crystal display module of this embodiment differs from the above-mentioned embodiment with respect to the circuit constitution of the ramp voltage generating circuit.

Hereinafter, this embodiment will be explained by focusing on points which make this embodiment different from the above-mentioned embodiment.

In this embodiment, the ramp voltage generating circuit 402 generates a ramp voltage having a positive inclination (RAMP1) when the alternating signal (M) assumes the H level and a ramp voltage having a negative inclination (RAMP2) when the alternating signal (M) assumes the L level. Accordingly, in this embodiment, the complement circuit 600 can be omitted.

Figure 16:
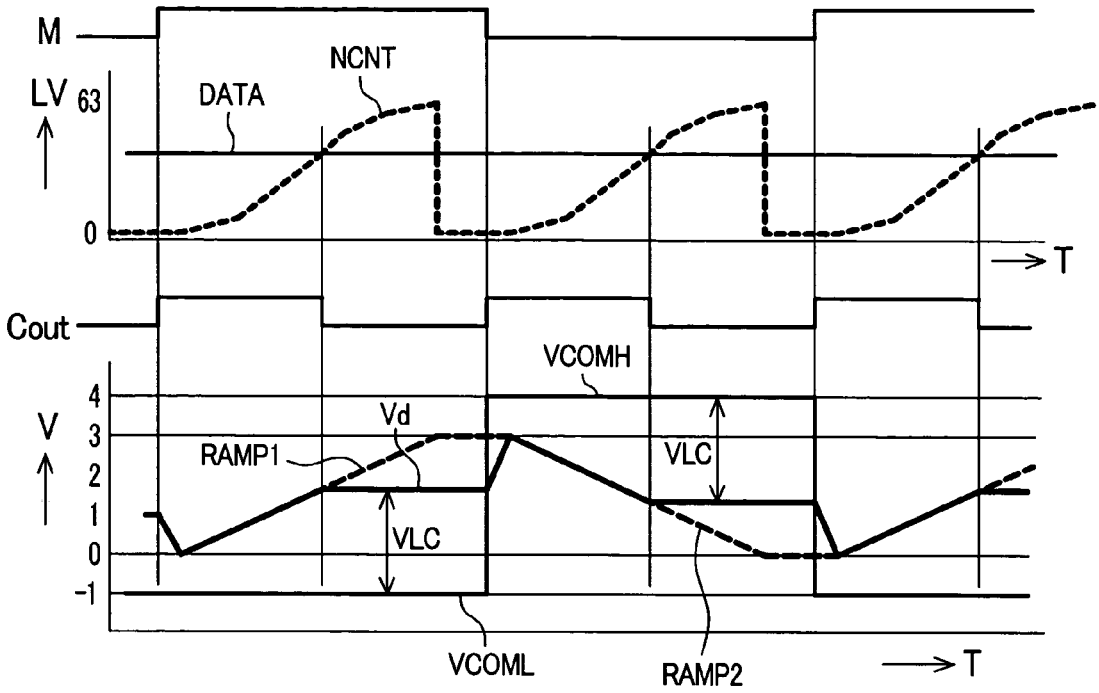
FIG. 16 is a timing chart showing the manner of operation of the liquid crystal display module of an embodiment 2 of the present invention.

FIG. 16 is a timing chart showing the manner of operation of the liquid crystal display module of this embodiment. Here, in FIG. 16, symbol LV indicates display data of 64 gray scales, symbol V indicates a common voltage applied to the common electrodes (ITO2) and one example of a gray scale voltage applied to the video line (D), and symbol T indicates time.

As shown in FIG. 16, when the alternating signal (M) assumes the H level, the ramp voltage generating circuit 402 outputs an inclined-wave voltage (RAMP1) which is simply increased from 0V to 3V; while, when the alternating signal (M) assumes the L level, the ramp voltage generating circuit 402 outputs an inclined-wave voltage (RAMP2) which is simply decreased from 3V to 0V.

Figure 17:
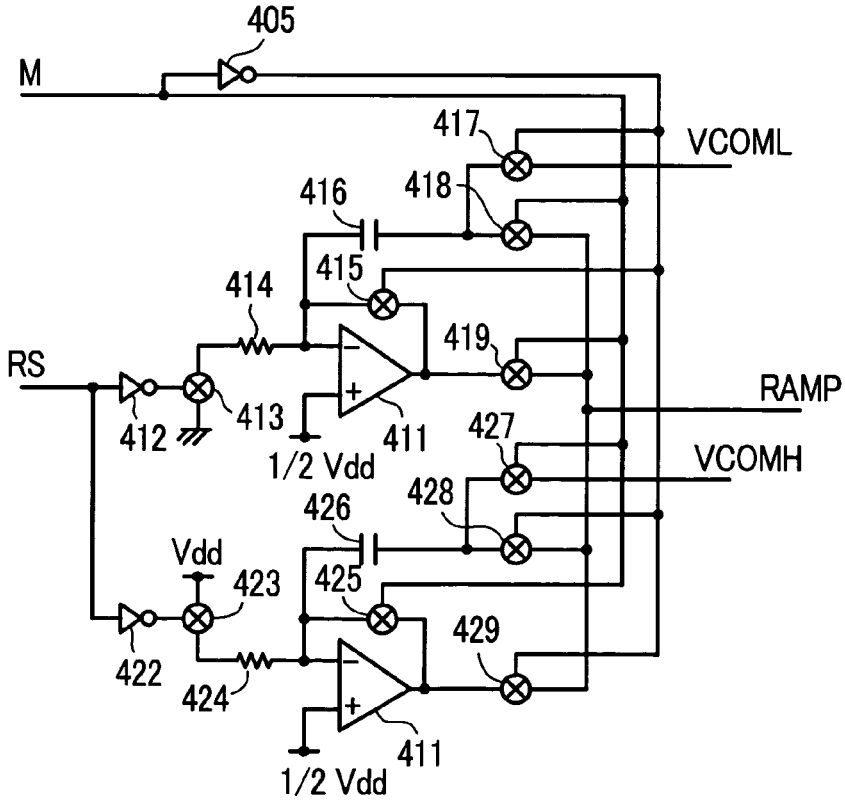
FIG. 17 is a circuit diagram showing the circuit constitution of one example of a ramp voltage generating circuit shown in FIG. 15.

FIG. 17 is a circuit diagram showing the circuit constitution of one example of the ramp voltage generating circuit 402 shown in FIG. 15.

The ramp voltage generating circuit shown in FIG. 17 is constituted of two ramp voltage generating circuits which generate a ramp voltage having a positive inclination (RAMP1) and a ramp voltage having the negative inclination (RAMP2).

The ramp voltage generating circuit which generates the ramp voltage (RAMP1) is constituted of an arithmetic amplifier 411, an inverter 412, switching elements (413, 415, 417, 418, 419), a resistor 414 and a capacitor 416.

The ramp voltage generating circuit which generates the ramp voltage (RAMP2) is constituted of an arithmetic amplifier 421, an inverter 422, switching elements (423, 425, 427, 428, 429), a resistor 424 and a capacitor 426.

When the alternating signal (M) assumes the H level, the switching elements (418, 419, 427, 425) are turned on and the switching elements (415, 417, 428, 429) are turned off; while, when the alternating signal (M) assumes the L level, the switching elements (418, 419, 427, 425) are turned off and the switching elements (415, 417, 428, 429) are turned on.

When the alternating signal (M) assumes the H level, an output of the ramp voltage generating circuit is provided as an output of the arithmetic amplifier 411. In this case, when the alternating signal (M) assumes the L level before assuming the H level, one terminal (a terminal connected to the resistor 414) of the capacitor 416 assumes a potential of (½) Vdd and the other terminal of the capacitor 416 assumes the low-potential-side common voltage (VCOML).

In such a state, when the reset signal (RS) assumes the L level from the H level, the capacitor 416 is charged and the output of the arithmetic amplifier 411 assumes the ramp voltage (RAMP1), which is elevated along with the lapse of time from the low-potential-side common voltage (VCOML).

In such a state, one terminal (the terminal connected to the resistor 424) of the capacitor 426 is charged with the potential of (½) VDD and the other terminal of the capacitor 426 is charged with the high-potential-side common voltage (VCOMH).

Next, when the alternating signal (M) assumes the L level, the output of the ramp voltage generating circuit is provided as the output of the arithmetic amplifier 421. Here, one terminal (the terminal connected to the resistor 424) of the capacitor 426 assumes a potential of (½) Vdd and another terminal of the capacitor 426 assumes the high-potential-side common voltage (VCOMH).

In such a state, when the reset signal (RS) assumes the L level from the H level, the capacitor 426 is charged and the output of the arithmetic amplifier 411 assumes the ramp voltage (RAMP2), which is decreased along with the lapse of time from the high-potential-side common voltage (VCOMH).

In such a state, one terminal (the terminal connected to the resistor 414) of the capacitor 416 is charged with the potential of (½) Vdd and the other terminal of the capacitor 416 is charged with the low-potential-side common voltage (VCOML).

Figure 18:
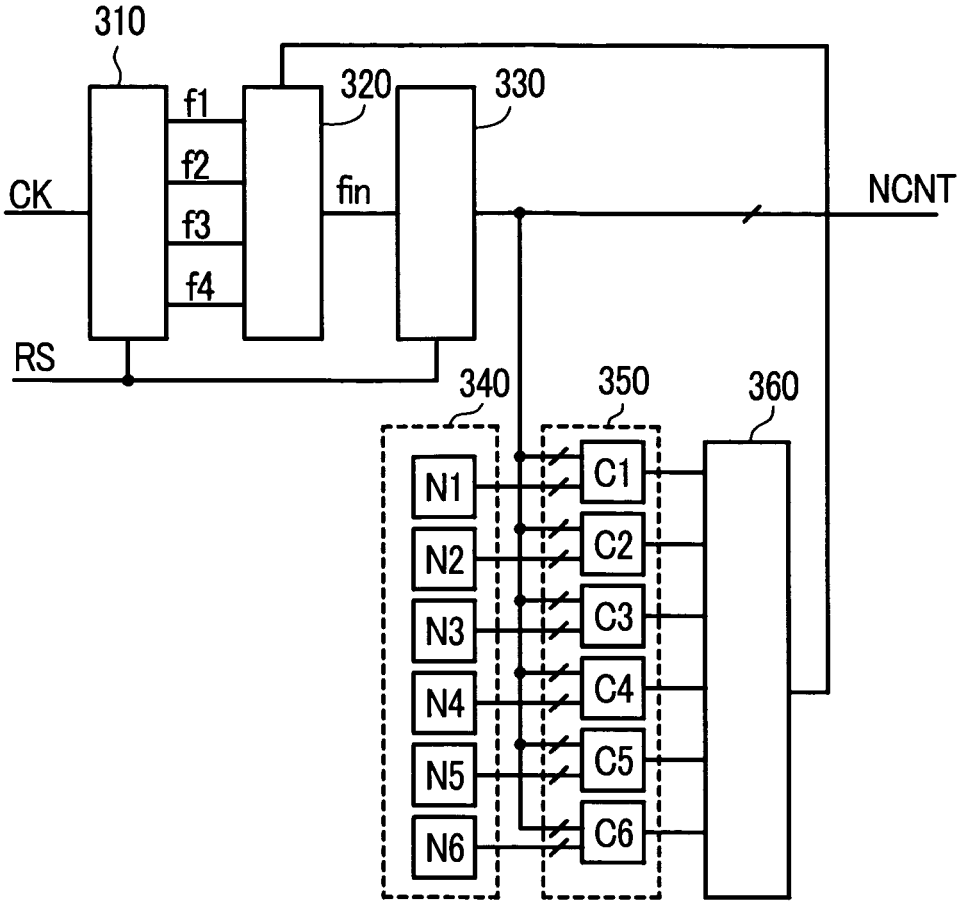
FIG. 18 is a block diagram showing the schematic constitution of the reference data generating circuit shown in FIG. 15.
Figure 19:
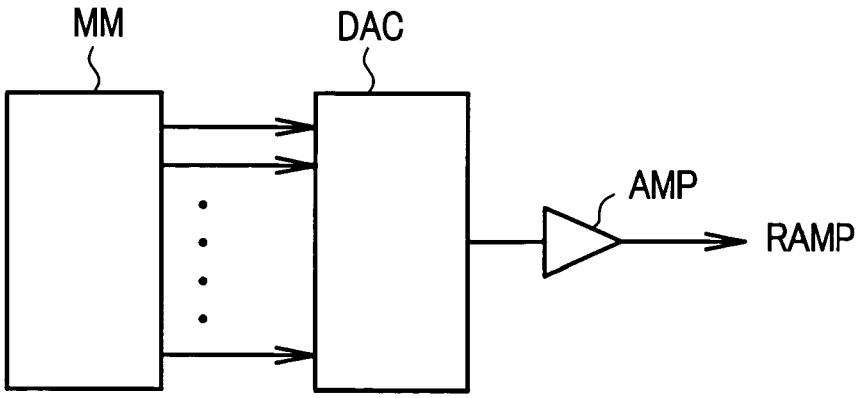
FIG. 19 Prior Art
FIG. 19 is a diagram showing one example of a conventional gamma correction method.

FIG. 18 is a block diagram showing the constitution of the reference data generating circuit 300 shown in FIG. 15. As shown in FIG. 18, the reference data generating circuit 300 of this embodiment differs from the reference data generating circuit 300 of the above-mentioned embodiment in that the complement control circuit 390 is omitted.

As explained above, in this embodiment, it is possible to apply a thin film transistor which is prepared by a pseudo single crystallization technique to the sample holding circuit 150, and, hence, the electrical performance of the drain driver 100 can be enhanced, whereby a liquid crystal display device of high quality and low power consumption can be realized.

Further, since gamma correction of the video signal voltage applied to the liquid crystal is performed using the reference data generating circuit 300, it is possible to make the ramp voltage that is outputted from the ramp voltage generating circuit 400 have substantially a fixed inclination. Accordingly, even when a delay exists in the voltage waveform of the ramp voltage on the video line (D), it is possible to substantially fix the error, whereby it is possible to apply gamma correction to a drain driver of high accuracy.

Further, the reference data generating circuit 300 can be realized by a logic circuit, and, hence, the reference data generating circuit 300 can be easily formed on the same substrate on which the display part 800 is formed. Further, since the data for gamma correction is stored in the registers, the data can be individually set for every product or every panel.

Further, with respect to the ramp voltages (RAMP, RAMP1, RAMP2) which are outputted from the ramp voltage generating circuit 400, these ramp voltages can hold respective positive and negative inclinations without changing the inclinations, and, hence, the circuit can be simplified, and at the same time, the ramp voltage generating circuit 400 can be formed on the same substrate on which the display part 800 is formed.

In this manner, according to the liquid crystal display module of this embodiment, by performing gamma correction on individual liquid crystal modules at the time of shipping or by performing a temperature compensation which changes the correction value in response to temperature, it is possible to realize a display of higher quality.

Further, by forming the drain driver and the peripheral circuits on the same substrate on which the display part 800 is formed using the thin film transistors in place of the IC chips, the number of parts and the number of connection terminals can be decreased, whereby a display of high reliability can be realized.

Further, since the alternation is performed using the sample holding circuit 150, it is possible to allow the ramp voltages (RAMP, RAMP1, RAMP2) which are outputted from the ramp voltage generating circuit 400 to hold the respective positive and negative inclinations as they are without changing them. Accordingly, the voltage amplitude can be reduced, whereby the power consumption can be reduced.

Further, since the output impedance of the ramp voltage generating circuits (400, 402) is reduced, the delay time can be shortened, whereby it is possible to obtain a display image of high quality.

Here, with respect to the explanation made heretofore, various embodiments in which the present invention is applied to a liquid crystal display module have been explained. However, it is needless to say that the present invention is not limited to these embodiments and that the present invention is applicable to other display devices, such as an EL display device.

Although the present invention has been specifically explained in response to the above-mentioned embodiments, it is needless to say that the present invention is not limited to the above-mentioned embodiments and various modifications can be made without departing from the gist of the present invention.

What is claimed is:

1. A display device comprising:

a display part having a plurality of pixels;

a plurality of video lines which supply a video signal voltage to the plurality of pixels; and a drive circuit which supplies the video signal voltage to the plurality of video lines, wherein the display part includes common electrodes, the drive circuit includes:

a common voltage generating circuit which selectively outputs a high-potential-side common voltage or a low-potential-side common voltage to the common electrodes in response to an alternating signal;

a storage circuit which stores display data;

a reference data generating circuit which generates reference data;

a ramp voltage generating circuit which generates a ramp voltage;

a plurality of comparing circuits which compare data stored in the storage circuit and the reference data generated by the reference data generating circuit; and a plurality of sampling circuits which sample the ramp voltage generated by the ramp voltage generating circuit in response to comparison results of the comparing circuits and output the sampled ramp voltage as a video signal voltage to respective video lines, wherein the reference data generated by the reference data generating circuit is changed non-linearly with respect to time.

2. A display device according to claim 1, wherein the drive circuit includes a complement circuit which selectively outputs the display data or complement data of the display data in response to the alternating signal, the storage circuit stores data outputted from the complement circuit.

3. A display device according to claim 1, wherein the drive circuit is integrally formed on the substrate on which the display part is formed using thin film transistors.

4. A display device according to claim 1, wherein the reference data generating circuit includes:

a selection circuit which allows a plurality of clocks having different frequencies to be inputted thereinto and selects one clock out of the plurality of clocks in response to a selection control signal;

a counter which counts the clock selected by the selection circuit and outputs the count number as the reference data; and a control part which transmits a selection control signal indicative of the clock to be selected by the selection circuit to the selection circuit in response to a preset count number and the count number of the counter.

5. A display device according to claim 4, wherein the control part includes:

a plurality of registers which store the preset count number;

a complement control circuit which selectively outputs the count number stored in the respective registers or the complement of the count number stored in the respective registers in response to the alternating signal;

a plurality of comparators which compares the count number outputted from the complement control circuit and the count number of the counter; and a control circuit which generates the selection control signal in response to comparison results of the plurality of comparators.

6. A display device comprising:

a display part having a plurality of pixels;

a plurality of video lines which supply a video signal voltage to the plurality of pixels; and a drive circuit which supplies the video signal voltage to the plurality of video lines, wherein the display part includes common electrodes, the drive circuit includes:

a common voltage generating circuit which selectively outputs a high-potential-side common voltage or a low-potential-side common voltage to the common electrodes in response to an alternating signal;

a storage circuit which stores display data;

a reference data generating circuit which generates reference data;

a ramp voltage generating circuit which selectively outputs a ramp voltage having the positive inclination or a ramp voltage having the negative inclination in response to the alternating signal;

a plurality of comparing circuits which compare the display data stored in the storage circuit and the reference data generated by the reference data generating circuit; and a plurality of sampling circuits which sample the ramp voltage having the positive inclination or the ramp voltage having the negative inclination generated by the ramp voltage generating circuit in response to comparison results of the comparing circuit and output the sampled ramp voltage as a video signal voltage to respective video lines, wherein the reference data generated by the reference data generating circuit is changed non-linearly with respect to time.

7. A display device according to claim 6, wherein the drive circuit is integrally formed on the substrate on which the display part is formed using thin film transistors.

8. A display device according to claim 6, wherein the reference data generating circuit includes:

a selection circuit which allows a plurality of clocks having different frequencies to be inputted thereinto and selects one clock out of the plurality of clocks in response to a selection control signal;

a counter which counts the clock selected by the selection circuit and outputs the count number as the reference data; and a control part which transmits a selection control signal indicative of the clock to be selected by the selection circuit to the selection circuit in response to a preset count number and the count number of the counter.

9. A display device according to claim 8, wherein the control part includes:

a plurality of registers which store the preset count number;

a plurality of comparators which compare the count number stored in the respective registers and the count number of the counter, and a control circuit which generates the selection control signal in response to comparison results of the plurality of comparators.

* * * * *